United States Patent [19]

Nilson

[11] 4,141,475

[45] Feb. 27, 1979

[54] LOCKING DEVICE FOR A SELF-CLOSING CLOSURE

[75] Inventor: Billy N. Nilson, Mjölby, Sweden

[73] Assignee: KeNova AB, Malmo, Sweden

[21] Appl. No.: 813,303

[22] Filed: Jul. 6, 1977

[30] Foreign Application Priority Data

Jul. 12, 1976 [SE] Sweden ..... 7607931

[51] Int. Cl.[2] ..... B65D 25/40

[52] U.S. Cl. ..... 222/494; 222/548

[58] Field of Search ..... 222/153, 212, 213, 498, 222/499, 491–494, 548, 511, 513, 514, 520, 521, 495, 496; 137/508

[56] References Cited

U.S. PATENT DOCUMENTS

| | | | |
|---|---|---|---|
| 1,261,814 | 4/1918 | Hoefler et al. | 222/213 |
| 1,709,948 | 4/1929 | Proctor | 222/494 |
| 4,061,254 | 12/1977 | Nilson | 222/499 |

*Primary Examiner*—Allen N. Knowles
*Assistant Examiner*—H. Grant Skaggs
*Attorney, Agent, or Firm*—Finnegan, Henderson, Farabow & Garrett

[57] ABSTRACT

A locking device for a self-closing closure of the kind which is provided to be connected to a package and which comprises a diaphragm member and a central member having a stem forming a valve with an opening in said diaphragm member comprising a tubular portion connected to or integral with the diaphragm member and a cylindrical portion connected to or integral with the central member. The tubular and cylindrical portions sealingly engage each other in the closed position of the closure and are each provided with openings. The diaphragm member and the central member are connected to each other in a manner enabling the closure members to be angularly displaced relative to each other. In a first angular position of said members the openings of the tubular and cylindrical portions are in registry thereby establishing free flow communication between the interior of the closure and the interior of the package, and in a second angular position said openings are out of registry thereby preventing flow communication between the interior of the closure and the interior of the package.

3 Claims, 5 Drawing Figures

LOCKING DEVICE FOR A SELF-CLOSING CLOSURE

BACKGROUND OF THE INVENTION

1. Field of the Invention

This invention relates to a locking device for a self-closing closure and more particularly it refers to a locking device forming part of the closure.

Self-closing closures for tubes or the like for dispensing flowable material upon the application of pressure upon the content of the tube have been well known for many years.

Self-closing closures of the kind referred to work very well but when tubes and the like utilizing such closures are to be transported, special arrangements have to be made to prevent leakage as any pressure exerted upon the tube will cause the pressure upon the content of the tube to be raised and if such a pressure is sufficiently high a dispensing takes place.

Attempts have been made to lock the central part of the diaphragm in its closed position but such a locking results in deformation of the thin diaphragm when a pressure is exerted upon the tube and if such a pressure is high, the deformation will be permanent or there occurs a rupture and in both cases the closure will not be able to function in a proper manner.

2. Brief Summary of the Invention

It is therefore the primary object of this invention to provide an improved locking device for self-closing closures.

It is another object of the invention to provide an improved locking device which releases the diaphragm from any stress when in its closed and locked position.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the self-closing closure for a package comprises a diaphragm member and a central member having a stem which forms a valve with an opening in said diaphragm, the diaphragm member and the central member being connected to each other in peripheral parts thereof and in a manner enabling said diaphragm member and said central member to be angularly displaced relative to each other, the diaphragm member having a tubular portion sealingly surrounding a cylindrical portion of the central member, the tubular portion and the cylindrical portion having openings which in one angular position of the diaphragm member and the central member register to establish free flow communication between the interior of the package and the interior of the closure but which in another angular position of the diaphragm member and the central member are out of registry to prevent flow communication between the interior of the package and the interior of the closure.

It is preferred that the cylindrical portion of the central member is tubular and that the diaphragm member has a peripheral resilient lip which diverges in the dispensing direction of the closure and that said lip is adapted to be snapped into a circumferential groove of a resilient lip included in the central member which in turn is adapted to be snapped into a groove or channel of a package or the like.

BRIEF DESCRIPTION OF THE DRAWINGS

The accompanying drawings, which are incorporated in and constitute a part of this specification illustrate two embodiments of the invention and, together with a description, serve to explain the principles of the invention.

Of the drawings.

DETAILED DESCRIPTION OF THE PREFERRED EMBODIMENTS

Reference will now be made in detail to the preferred embodiments of the invention, examples of which are illustrated in the accompanying drawings.

Figure 1:
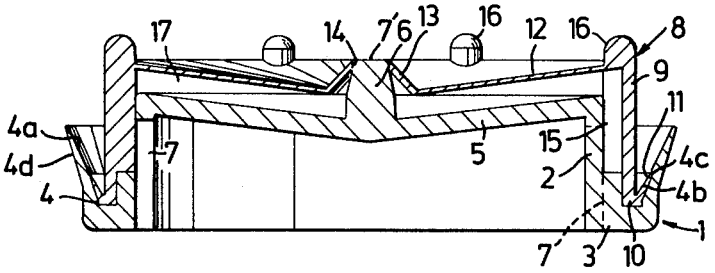
FIG. 1 is a cross section of one embodiment of the invention, the closure being shown in its closed and locked position.
Figure 2:
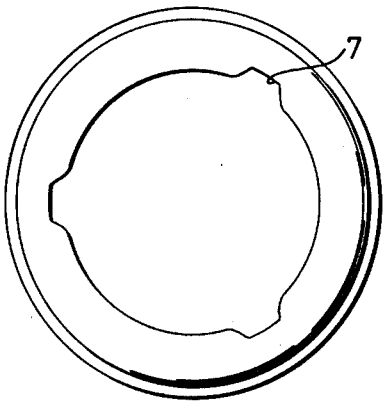
FIG. 2 is plan view from the under side of the central member of the closure.

Referring to FIG. 1 it will be seen that the closure comprises a first closure member 1 having an cylindrical portion 2 which in one end thereof merges into a base portion 3 provided with a peripheral, profiled groove 4 and in the other end thereof merges into a disc-shaped wall 5 the central portion of which having an axially extending stem 6 which has an end portion 7 provided to form part of a valve. A number of through openings 7 are provided in the cylindrical portion 2. In order to obtain such openings without the use of an injection mold having sideways movable plates these openings 7 are — as will be seen in FIG. 2 — shaped as grooves which radially terminate at the same distance from the centre as the outer surface of the cylindrical portion, and in the axial direction they extend from the lower surface of the base portion to a point positioned at a higher level than the upper surface of the base portion.

The purpose of the profiled groove 4 is to lock the first closure member 1, hereinafter named the central member to the second member, hereinafter named the diaphragm member 8 and said profiled groove will be further described in connection with said diaphragm member 8.

The diaphragm member 8 has, similarly to the central member 1, a tubular portion 9 which merges into a base portion 10 in one end thereof and said base portion has a peripheral lip 11 diverging upwardly as seen in FIG. 1. Said lip tapers towards the free end thereof and at least in said free end it is thin-walled to yield the resiliency required for the assembling method to be described. In the other end or adjacent the other end thereof the tubular portion 9 merges into a thin disc-shaped resilient portion 12 which serves as a diaphragm and according to FIG. 1 is conical so that it slopes downwardly towards the centre thereof. The diaphragm 12 merges into a sleeve 13 in the central portion thereof and said sleeve has an opening 14 which is so calibrated that it may be kept closed by the end portion 7' of stem 6. In the position shown in FIG. 1 said end 7' of stem 6 is sealingly engaging said opening and consequently the closure is closed. A number of openings 15 are provided in the inner surface of the tubular portion 9 and said openings are preferably located at the same angular distance from each other as the openings 7 of the central member 1. It is understood that the openings 7 and 15 may be brought into and out of registry with each other by turning the closure members 1 and 8 relative to each other. In order to facilitate such turning movement the diaphragm member 8 has a plurality of axially extending projections 16 in the illustrated embodiment of the invention.

As mentioned in the preamble of this description the closure only comprises two parts and said parts or members are intended to be mutually connected by means of a snap action. To achieve this object the profiled groove 4 is designed according to FIG. 1, i.e. having two substantially parallel surfaces 4*a* and 4*b* meeting in a peripheral flange 4*c*. As a consequence of this design the base portion 4 has a peripheral, outwardly diverging lip defined by the surfaces 4*a*, 4*b*, 4*c* on the one hand and the outer surface 4*d* on the other hand. It is thus possible to connect the closure to a correspondingly shaped part of a bottle or the like in a simple snap action. It is understood that by bringing the members 1 and 8 together the lip 11 will slide against the surface 4*a*. Since the maximum diameter of the lip exceeds the minimum diameter of the surface 4*a* said lip 11 and the corresponding lip of the base portion 4 will be elastically deformed and when the lip passes the flange 4*c* said two lips will return to their original shapes, whereby a sealing connection is obtained between the members 1 and 8. In said connected position the members 1 and 8 may be turned relative to each other but they may not be separated from each other. The same condition is obtained when said lip of the base portion 4 is brought into engagement with a correspondingly shaped portion of a container such as a bottle and thus it is possible to connect the two members of the closure in the simpliest manner possible and to connect the closure to a container in the same simple manner.

When the members 1 and 8 of the closure are in such an angular position relative to each other that the openings 7 and 15 register there is a communication between the space 17 forming the interior of the closure and the interior of the container.

A pressure applied to the substance contained in the package or tube (said pressure is preferably obtained by manually squeezing the tube) will cause a deformation of the diaphragm 12 so that the central portion thereof is lifted to such an extent that the opening 14 of the sleeve 13 will be brought out of sealing engagement with the end portion 7' of the stem. In this position the substance may flow out from the opening 14. When the pressure upon the interior of the tube ceases, the diaphragm will return to the original position thereof and thus the closure will automatically close. The positions described above define the normal operational and idle positions of the closure.

However, in order to make the closure inoperative also when the tube or the like is subjected to a pressure that normally would give rise to the opening of the closure, it is only necessary to turn the member 8 such that the openings 15 thereof are no longer in register with the openings 7 of the closure member 1. The communication between the interior of the closure and the interior of the tube is now broken and a pressure applied to the contents of the tube is therefore no longer transmitted to the diaphragm which is not deformed or stressed in any way.

It is understood that is is possible to provide the closure members 1,8 with cooperating elements to obtain a signal that can be sensed when the closure members are in mutually engaging locked or unlocked positions.

Figure 3:
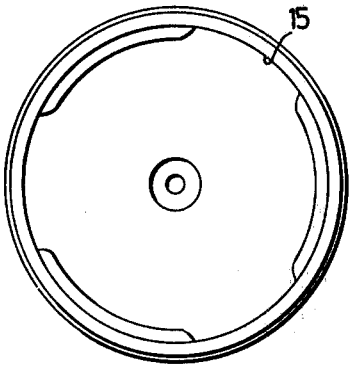
FIG. 3 is a plan view from the under side of the diaphragm member of the closure.
Figure 4:
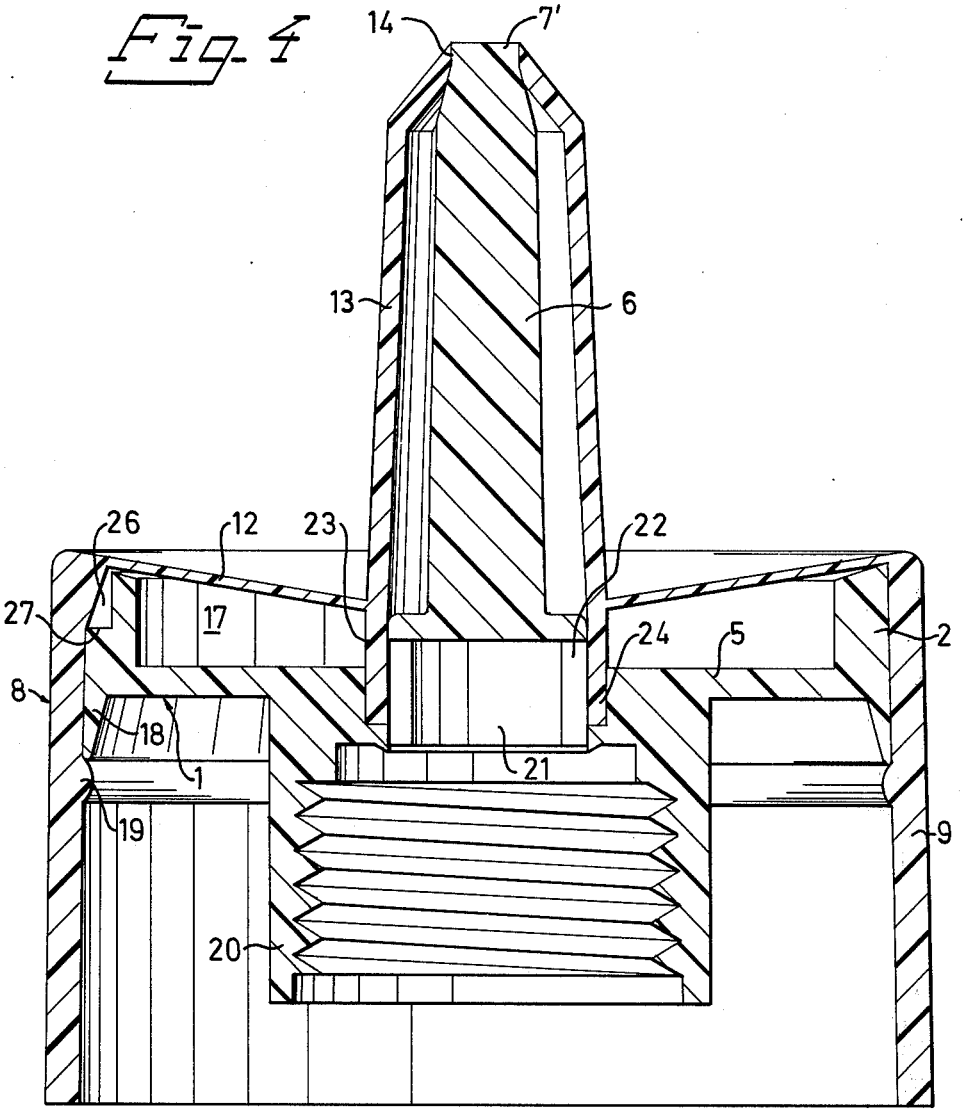
FIG. 4 is a cross section of a second embodiment of the invention.
Figure 5:
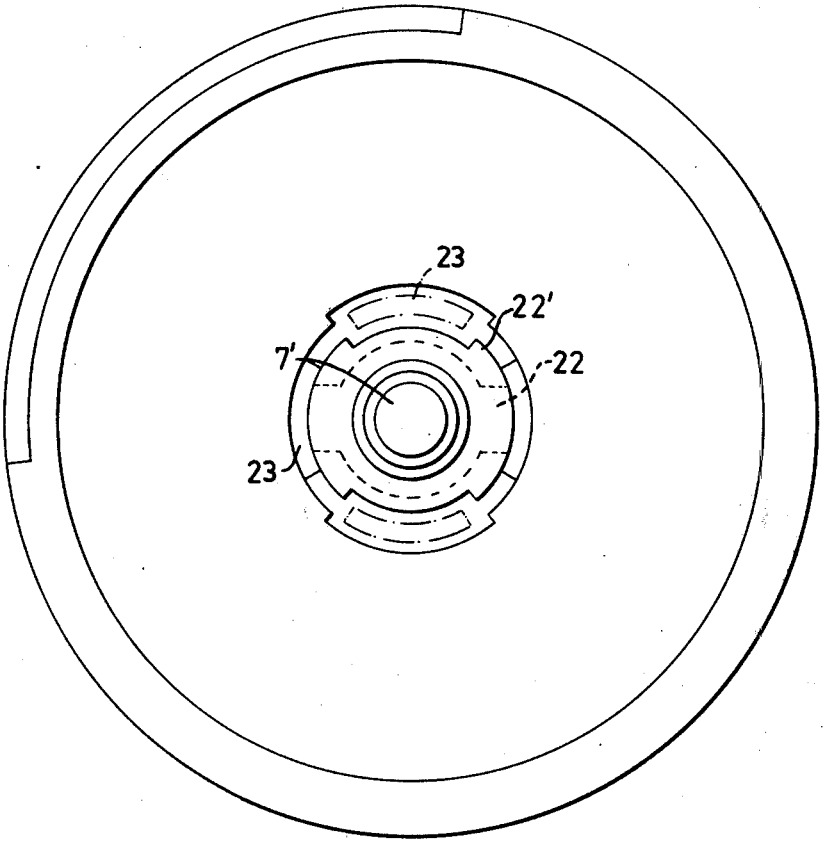
FIG. 5 is a plan view of the closure, the diaphragm being transparent.

In the embodiment illustrated in FIGS. 4–5 the material to be dispensed is fed to the interior 17 of the closure similarly to the embodiment described above and in a substantially radial direction but contrary to the described embodiment the feeding is not accomplished from the periphery of the closure but from the central portion thereof. Further—, the closure is designed to be threaded onto a tube or the like but despite the difference in design the general designations from FIGS. 1–3 have been maintained also in FIGS. 4 and 5 since the function of the parts is principally the same.

The central member 1 has a circumferential resilient lip 18 to be connected to the diaphragm member 8 by a snapping action and member 8 has to this end a circumferential bead 19 and the lip is pushed over said bead during assemblage. Hereby the two closure members are connected to each other in such a manner that they may be turned relative to each other. The wall 5 of the closure member 1 has further a sleeve shaped connection portion 20 which as can be seen may be inwardly threaded so that it may be threaded onto an ordinary tube of the tooth-paste tube type. A downwardly open recess 21 is formed in the stem 6 and may communicate with the interior 17 of the closure by means of openings 22. The diaphragm member 8 is provided with a sleeve 23 extending in a direction oppposite to that of sleeve 13 and the free end thereof is guided in a recess 24 provided in wall 5. The sleeve 23 has openings 25 which may be brought into and out of registry with the openings 22. It can be seen that in the first case a communication is provided between the interior of the closure and of the tube and that said communication does not exist in the latter mentioned case and similarly to the embodiment described above, the locking of the closure is thus obtained by turning the two closure members relative to each other. In order to limit this turning movement and also give an indication of the angular position obtained, the closure members may have co-operating parts such as one or several projections 26 of diaphragm member 8 and recesses 27 of suitable peripheral extension in central member 1. The projection is preferably so shaped that it effectively prevents turning movement past the position in which the closure is closed, i.e. with the openings 22 and 25 in non-registered position and in the open position with the openings 22 and 25 in registered position respectively.

The lower edge portion of the flange 20 may be serrated so that said flange will be secured to the end of the tube upon threading.

It may be noted that the sleeve 23 can be arranged to sealingly engage stem 6 only in the closed position of the closure or also when the closure is in open position.

What is claimed is:

1. A locking device for a self-closing closure for a package, said device comprising a diaphragm member having a resilient diaphragm, provided with a centrally located sleeve and a central member having a wall, provided with a centrally located stem projecting from said wall and having its end provided to sealingly engage said sleeve in the closed position of the closure, wherein said diaphragm member and said central member have outer, peripheral parts thereof mutually connected in a sealing manner and in a manner enabling said diaphragm member to be angularly displaced relative to said central member, said central member having a cylindrical portion, provided with openings therein for establishing flow communication with the interior of the package, said diaphragm member having a tubular portion sealingly engaging said cylindrical portion of said central member at least in the closed position of the closure, said tubular portion of said diaphragm member also having openings which, depending upon the relative angular positions of said diaphragm member and said central member, are in or out of registry with the openings of said cylindrical portion to establish or cut off flow communication between the interior of the closure and the package.

2. The locking device of claim 1 wherein said diaphragm member has a peripheral resilient annular lip diverging in the dispensing direction of the closure, said lip being adapted to be snapped into a circumferential groove of a resilient, annular lip included in said central member, said central member having also a resilient annular lip being provided to be snapped into a groove of a tube or some other package.

3. The locking device of claim 1, wherein said tubular and cylindrical portions are centrally located in the closure.

* * * * *